US005137015A

United States Patent [19]

Anglehart

[11] Patent Number: 5,137,015

[45] Date of Patent: Aug. 11, 1992

[54] APPARATUS FOR SUPPORTING AND MOVING A PERSON'S HEAD

[76] Inventor: James Anglehart, P.O. Box 65722, Stn. 'F', Vancouver, Canada, V5N 5K7

[21] Appl. No.: 659,730

[22] Filed: Feb. 22, 1991

[51] Int. Cl.[5] ..... A61H 1/00

[52] U.S. Cl. ..... 128/24 R; 297/408

[58] Field of Search ..... 128/70, 71, 33, 35; 297/403, 406, 408; 606/237

[56] References Cited

U.S. PATENT DOCUMENTS

| | | | |
|---|---|---|---|
| 2,703,080 | 1/1951 | Sanders | 128/71 |
| 2,717,593 | 8/1952 | Murphy | 128/33 |
| 3,998,218 | 12/1976 | Lane et al. | 128/70 |
| 4,221,213 | 9/1980 | Gregory et al. | 128/70 |

OTHER PUBLICATIONS

Hammacher-Schlemmer Catalog "R", p. 62, 1991 Personal Shiatzu Massager.

*Primary Examiner*—Richard J. Apley
*Assistant Examiner*—Susan L. Weinhoffer

[57] ABSTRACT

The person's head is supported and moved continuously along a path in a manner compatible with a possible movement of the person's head. The apparatus is used to induce relaxation or reduce tension, and may comprise: a head support for securely holding the person's head; a base; a motor provided on the base; and a mechanical linkage driven by the motor and connected to the base and to the head support for supporting the head support on the base and for moving the head support along the path when the person rests on a first surface and the base is supported by a second surface, the second surface being fixed with respect to the first surface.

19 Claims, 3 Drawing Sheets

APPARATUS FOR SUPPORTING AND MOVING A PERSON'S HEAD

FIELD OF THE INVENTION

The invention relates to an apparatus for supporting and moving a person's head along a path in a manner compatible with a possible movement of the person's head. The apparatus is used to induce relaxation or reduce tension.

BACKGROUND OF THE INVENTION

It is known in massage technique that manually supporting a person's head and gently moving it, is an effective method to reduce tension and induce relaxation. The feeling of having one's head moved around, while one is reclined and comfortable, gives a sensation of deep relaxation and letting-go. It would appear as if the movement allows one to stop tensing the neck muscles since the head is under the control and movement of the masseuse holding one's head.

The movement of the person's head need not be exagerated to be effective. Small rotations, or reciprocal motions, from left to right, up and down, turning right to left or gently pulling are the possible movements. Generally, a combination of movements in a slow, continuous manner provide a good sensation of relaxation.

Stress and neck tension are common in modern society. An effective and low cost apparatus or device is needed which can physically and directly induce relaxation or reduce stress in the privacy and comfort of one's own home.

SUMMARY OF THE INVENTION

It is an object of the invention to provide an apparatus or device which can physically induce relaxation or reduce stress without being too costly and requiring difficult installation.

According to the invention, there is provided an apparatus for supporting and moving a person's head comprising: a base; a head support for securely holding the person's head; drive means connected to the base and the head support for supporting the head support on the base and for moving the head support along a path in a manner compatible with a possible movement of the person's head. When the person rests on a first surface, the base is supported by a second surface, and the second surface is fixed with respect to the first surface, the person's head may be moved continuously along said path in order to induce relaxation or reduce tension.

Preferably, the head support comprises a base portion and two opposed side portions for securely and snugly receiving a bottom and sides, respectively, of the person's head.

Preferably, the base may comprise an overhead portion supported by a pair of side members, and the head support may comprise a strip of flexible material suspended at its ends by the overhead portion of the base.

Preferably, the drive means may comprise: an electric motor powered by a power supply; a mechanical linkage having an input connected to the motor and being connected to the base and supporting the head support, the linkage having an output connected to the head support and being able to move the head support with respect to the base in response to the motor.

DETAILED DESCRIPTION OF THE PREFERRED EMBODIMENTS

Figure 1:
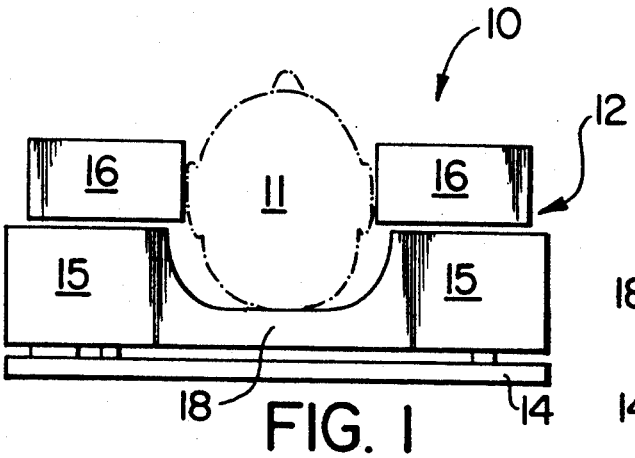
FIG. 1 is an end view of a first preferred embodiment of the invention.
Figure 2:
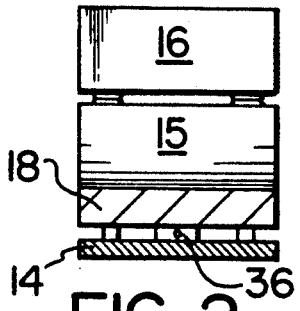
FIG. 2 is a break away side view of the first preferred embodiment.
Figure 3:
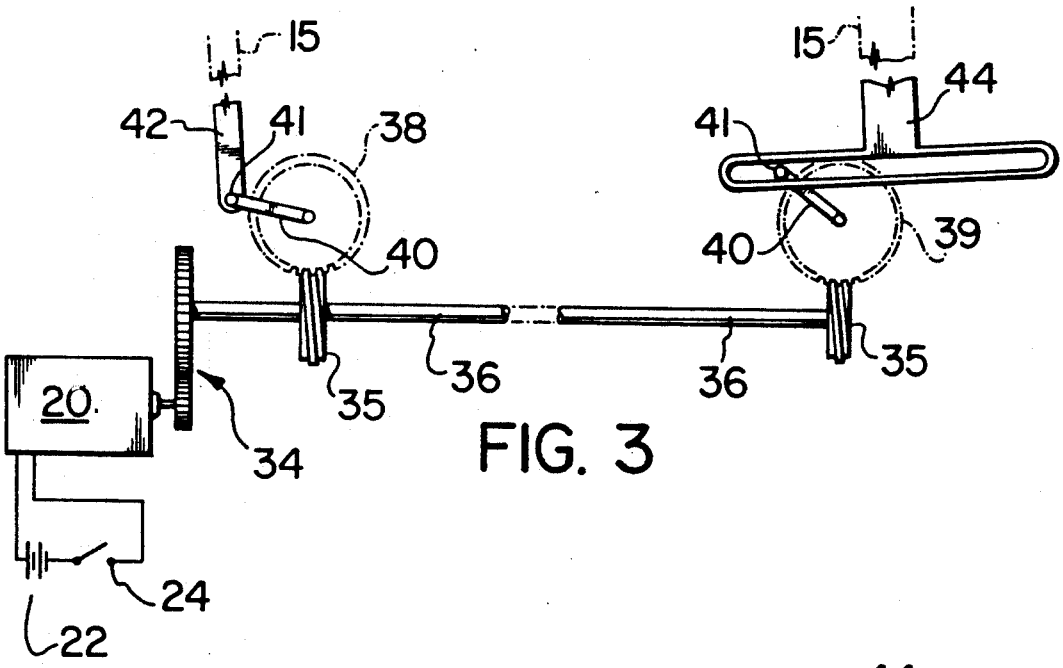
FIG. 3 is a schematic end view of the mechanical linkage of the preferred embodiments.

In the first preferred embodiment shown in FIGS. 1, 2 and 3, the apparatus (10) has a flat lying base (14) on top of which a head support (12) is provided. The head support (12) is rectangularly shaped and has a padded U-shaped hollowed middle portion which is shown in FIG. 1 as receiving a person's head (11). Head (11) is supported from underneath (the back of the head) by a padded cross portion (18), and from the sides by cushions (16) which are attached to the sides (15) of the support (12) by strips of Velcro (TM) to allow for adjustment of the separation of cushions (16) to accomodate different sizes of heads (11).

Figure 4:
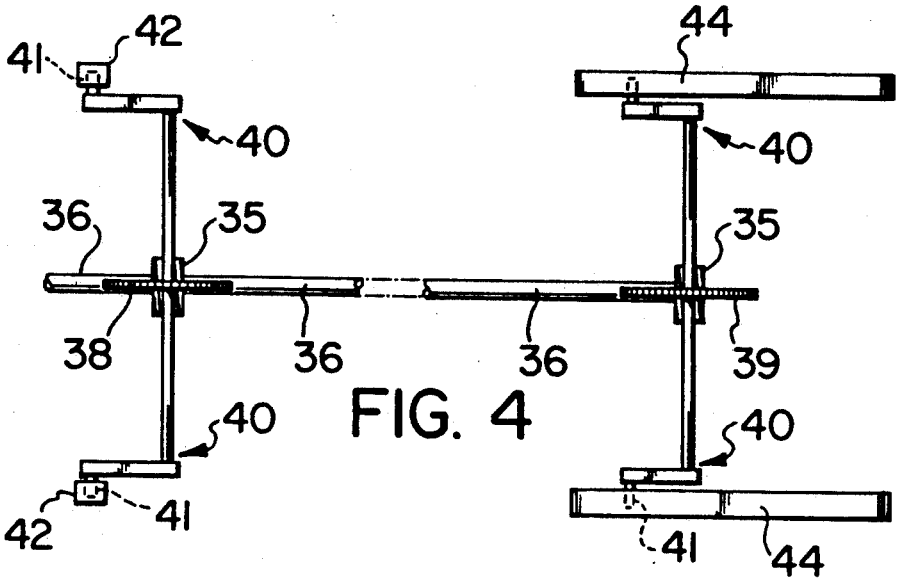
FIG. 4 is a schematic top view of FIG. 3.

As shown in FIGS. 3 and 4, the base (14) supports drive means consisting of a 6 V DC electric motor (20) which has an output connected to an input of a speed reduction gear box (34). Gear box (34) has a drive shaft (36) provided with two worm gears (35) which are meshed with gears (38) and (39). A crank shaft (40) having one crank and pin (41) at each end is connected to gear (38) and another crank shaft (40) is connected to gear (39). The appropriate mountings and bearings (not shown) are to be provided to fix motor (20) and the drive means to base (14) as is clear to one skilled in the art.

Gear (38) has a slightly smaller diameter and about 7% fewer teeth than gear (39) so that it rotates faster than gear (39) when driven by worm gear (35). Crank shaft (40) is pivotally connected to a first left side (15) of support (12) via pivot joints (42) and the other crank shaft (40) is pivotally and slideably connected to a second right side (15) of support (12) via tracks (44). Drive shaft (36) is provided with a very low clearance above base (14), so as not to interfere with bottom portion (18) of support (12) as it moves. Sides (15) are hollowed out to accomodate motor (20), speed reduction gears (34), gears (35), (38) and (39), as well as crank shafts (40). Space may also be provided for a battery (22) (e.g. four C-size batteries) as a power source.

Since the difference in rotational speed is little, support (12) will be driven in a varying orbital fashion in a plane perpendicular to the lengthwise axis of the person's body and in a path which changes from circular (top-center to middle-left to bottom-center to middle-right back to top-center with the support (12) horizontal and level) to a side to side twisting motion (middle-right-level to middle-center-twist-right to middle-left-level to middle-center-twist-left back to middle-right-level with the support (12) at middle height and twisting as it moves from right to center to left and back). The path is varying with each revolution slightly between the two extremes of paths.

Figure 7:
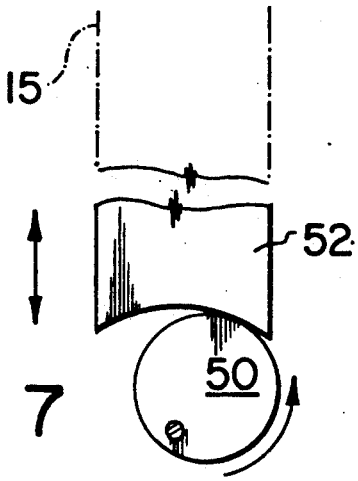
FIG. 7 is an enlarged detailed view of a cam and rod linkage according to another embodiment.

As shown in FIG. 7, the cranks (40) can alternatively be replaced by cams (50) which push on cam rods or surfaces (52) provided on sides (15).

Figure 5:
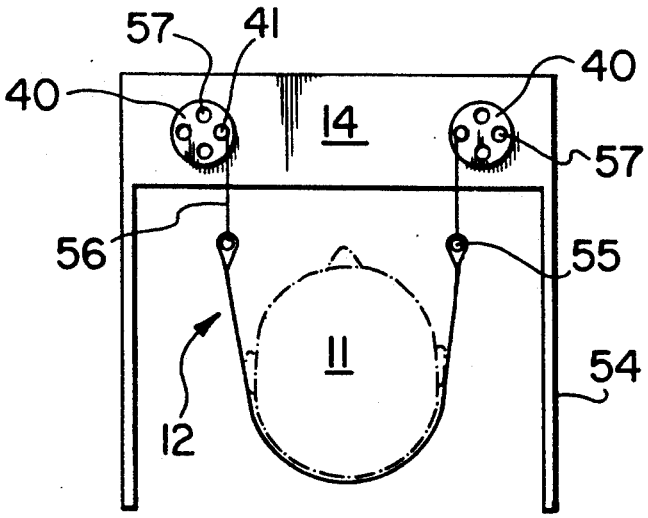
FIG. 5 is an end view of a second preferred embodiment of the invention.
Figure 6:
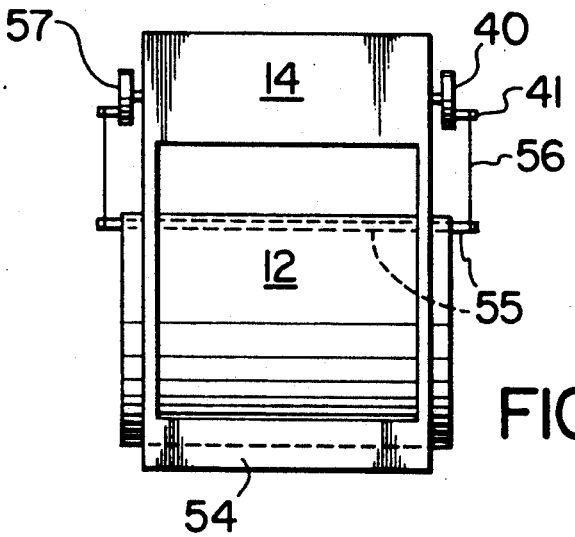
FIG. 6 is a side view of the embodiment of FIG. 5.

In the second preferred embodiment, as shown in FIGS. 5 and 6, head support (12) can comprise a strip of flexible material which has loops sewn into the ends through which wooden rods or dowels (55) are provided. The strip (12) is about 10 to 20 cm wide and acts as a sling or hammock to support the bottom and sides of head (11) when the strip (12) is supported from above. To this end, the base 14 has side leg members (54) to elevate crank shafts 40 and the drive means to be well above the person's head (11). The leg members (54) can be made removeable or foldable for easier storage of apparatus (10). Links (56) each pivotally connect the ends of rods (55) to pins (41) at the ends of crank shafts (40). In the second preferred embodiment, the support (12) can accomodate a wide range of head sizes without having to adjust the width.

In the second preferred embodiment, the drive means comprise, as in the first preferred embodiment, an electric motor (20), speed reduction gears (34), a shaft (36), worm gears (35) and gears (39) and (39) connected to the crank shafts (40) as shown in FIGS. 3 and 4. Pins (41) can be moved between holes (57) provided on crank shafts (40), to adjust the radius about which pins (41) rotate and thus the amplitude of movement of support (12). In this way, the user can select how much motion he wishes to experience. Holes (57) may be at a radius of 2, 2.5, 3 and 3.5 cm if four holes (57) are provided at the ends of crank shafts (40). In the preferred embodiments, the radius is about 3 cm. In the second preferred embodiment, the support (12) may also be connected to cranks (40) by means of interconnected pivot joints (42) and tracks (44) (FIG. 3).

Figure 8:
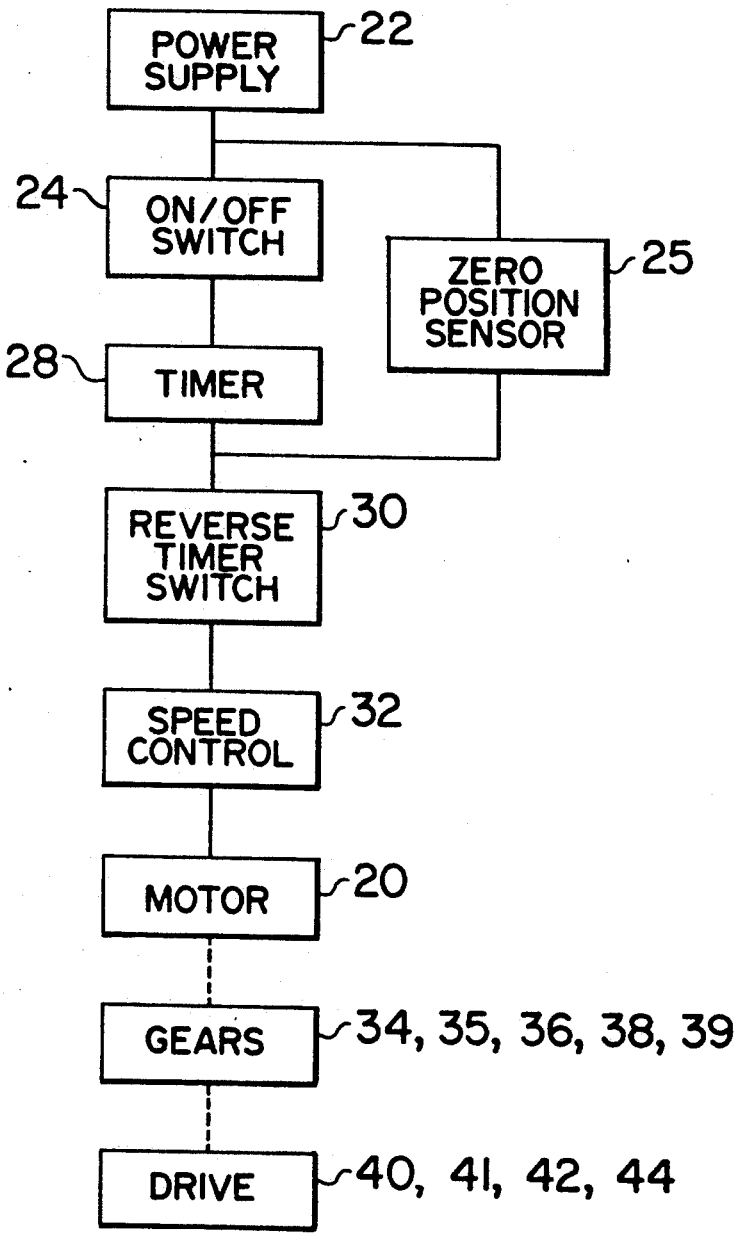
FIG. 8 is a block schematic diagram of the preferred embodiments.

FIG. 8 shows a block diagram of the preferred drive means. Power supply (22) is a battery supply or an AC/DC adapter. On/off switch (24) and zero position sensor switch (25) connect electrical power from supply (22) to the rest of the drive means. Timer (28), reverse switch (30) and speed control potientiometer are connected in series between switch (24) and motor (22). Timer (28) is an option which can be used to have apparatus (10) stop after a predetermined time period. For example, timer (28) can be set for 15 minutes so that if the user falls asleep after 10 minutes, the drive means need not continue indefinitely. However, even if switch (24) or timer (28) cuts power to motor (22), the zero position sensor (25) will continue to provide power until the drive means reach a zero position. By zero position, it is meant a position in which the user would not be uncomfortable if left in the position while asleep, or a central position which makes for a suitable initial position when first placing the head (11) in support (12) (e.g. if the zero position is not respected when head (11) is placed in support (12) with head (11) aligned with the person's neck and body, then it is possible that drive means be in the extreme right or left position before power is supplied and the path would move head (11) around to the right or left of the user's neck). Reverse switch (30) includes its own timer for reversing the direction of motion of the motor (22) every 5 or 10 minutes, for example. Both timer (28) and reverse switch (30) can be provided with override switches to deactivate their functions, as well as with adjustment controls.

Speed adjustment (32) is a potentiometer for adjusting the speed of motor (22), so that the user can vary the speed at which the drive means move support (12) along the path.

The drive means described above include a single DC electric motor for moving support (12) about one plane. It is alternatively possible to use more than one motor and to provide motion along a path or a plurality of paths in more than one plane, as would be compatible with the possible movements of head (11). Of course, an electric motor and a mechanical linkage is only one of the possible arrangements for the drive means, and for example, pneumatic drive means could also be provided for smooth and quiet movements.

The drive means have also been described herein as supporting head support (12) at four points, a pair on each side (15), each pair remaining at the same level. It is possible to stabilize head support (12) at two or more points depending on the configuration desired. Also, the points of support can be from the sides instead of from underneath or above support (12).

Although the adjustment of the radius of motion of pins (41) has been illustrated as being achieved by providing a number of holes (57), it is clear that there are other ways to make the radius about which pins (41) rotate adjustable. For example, pins (41) may be attached to cranks (40) via a radial track and adjustment screw.

It is also important when providing the motor (20) and mechanical linkage mountings, as described in the preferred embodiments, to insure proper mechanical vibration and sound insulation. The motor (20) can be mounted to base (14) using rubber pads and the motor output shaft can include a rubber segment to absorb vibrations. The connections between support (12) and pivot joint (42) and tracks (44) can also be provided with a vibration absorption material. For sound insulation, motor (20) can be placed in a sound absorbing, heat dissipating housing.

It is to be understood that the above description of the preferred embodiments is not intended to limit the scope of the present invention as defined in the appended claims.

I claim:

1. An apparatus for supporting and moving a person's head, the apparatus comprising:

a base;

a head support for securely holding the person's head;

drive means connected to the base and the head support for supporting the head support on the base and for moving the head support along a path in a manner compatible with a possible free movement of the person's head when the person rests on a first surface and the base is supported by a second surface, the second surface being fixed with respect to the first surface, the drive means controlling movement of the head support along said path to provide for continuous movement therealong, said path comprising movements along or about at least one axis, whereby the person's head may be moved continuously along said path in order to induce relaxation or reduce tension.

2. The apparatus of claim 1, wherein the head support comprises a base portion and two opposed side portions for securely and snugly receiving a bottom and sides, respectively, of the person's head.

3. The apparatus of claim 1, wherein the base comprises an overhead portion supported by a pair of side members, and wherein the head support comprises a strip of flexible material having two ends and suspended at the two ends by the overhead portion of the base.

4. The apparatus of claim 1, wherein the drive means comprise:

a motor powered by a power supply; and a mechanical linkage having a mechanical input and an output, the linkage connected to the base, the output connected to and supporting the head support, the input being connected to the motor, the linkage being able to move the head support with respect to the base in reponse to the motor.

5. The apparatus of claim 4, wherein the mechanical linkage comprises:

speed reduction gear means including said input and said output; and a plurality of cams connected to said output, the cams engaging cam engaging surfaces provided on the head support.

6. The apparatus of claim 4, wherein the mechanical linkage comprises:

speed reduction gear means including said input and said output; and at least one crank connected to said output, said at least one crank being pivotally connected to the head support.

7. The apparatus of claim 6, wherein the speed reduction gear means have two said outputs of slightly different speeds, the two outputs each being connected to at least one crank on each of two opposed sides of the base.

8. The apparatus of claim 7, wherein a first pair of cranks are provided on a first one of said sides of the base and a second pair of cranks are provided on a second one of said sides of the base, the first and second pair of cranks rotating about parallel axes, the first pair of cranks rotating coaxially, the second pair of cranks rotating coaxially, the first pair of cranks being pivotally connected to a corresponding first side of the head support, the second pair of cranks being pivotally connected to a corresponding second side of the head support, said cranks rotating in a plane substantially extending perpendicular to a longitudinal axis of the person's head.

9. The apparatus of claim 8, wherein the head support comprises a base portion and two opposed side portions for securely and snugly receiving a bottom and sides, respectively, of the person's head, and wherein the first pair of cranks are directly pivotally connected to the first side of the head support and the second pair of cranks have pins each slidable in a track provided in the second side of the support.

10. The apparatus of claim 9, wherein the speed reduction gear means include a drive shaft, first and second worm gears connected to the drive shaft, first and second drive gears driven by the first and second worms gears respectively at slightly different speeds, said first and second pairs of cranks being connected to and driven by said first and second drive gears respectively, said shaft extending sideways and having a low clearance passing below said base portion.

11. The apparatus of claim 9, wherein the two opposed side portions are adjustable in their sideways separation to allow receiving different sizes of heads.

12. The apparatus of claim 7, wherein the base comprises an overhead portion supported by a pair of side members, and wherein the head support comprises a strip of flexible material having two ends and suspended at the two ends by the overhead portion of the base, and wherein the cranks are pivotally connected to a first and a second one of said two ends.

13. The apparatus of claim 12, wherein said two ends each include a rod extending through a loop in said material, a link pivotally connected to one of said cranks and to each said rod.

14. The apparatus of claim 13, wherein a first pair of cranks are provided on a first one of said sides of the base and a second pair of cranks are provided on a second one of said sides of the base, the first and second pair of cranks rotating about parallel axes, the first pair of cranks rotating coaxially, the second pair of cranks rotating coaxially, the first pair of cranks being pivotally connected to a corresponding first side of the head support, the second pair of cranks being pivotally connected to a corresponding second side of the head support, said cranks rotating in a plane substantially extending perpendicular to a longitudinal axis of the person's head, a link being provided at each end of said rod and pivotally connected to said cranks.

15. The apparatus of claim 4, wherein the drive means further comprise a timer for providing power to the motor from the power supply during a predetermined time period.

16. The apparatus of claim 4, wherein the drive means further comprise a motor speed controller for adjusting a speed of the motor.

17. The apparatus of claim 4, wherein the drive means further comprise motor reverse means including a timer and a reversing switch for reversing a direction of motion of the motor after predetermined time periods.

18. The apparatus of claim 4, wherein the drive means further comprise a zero position sensor switch for continuing to provide power to the motor until a zero position is reached.

19. The apparatus of claim 6, wherein the cranks have pins which are adjustable in their radius of rotation to allow for an adjustment of an amplitude of motion imparted to the head support.

* * * * *